US006337596B1

(12) United States Patent
Shimozono

(10) Patent No.: US 6,337,596 B1
(45) Date of Patent: Jan. 8, 2002

(54) CONSTANT CURRENT CIRCUIT USING CURRENT MIRROR CIRCUIT

(75) Inventor: Masahiro Shimozono, Kitakyushu (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/662,130

(22) Filed: Sep. 14, 2000

(30) Foreign Application Priority Data

Sep. 14, 1999 (JP) ..... 11-260269
Mar. 31, 2000 (JP) ..... 12-098024

(51) Int. Cl.[7] ..... G05F 1/10
(52) U.S. Cl. ..... 327/538; 327/103; 323/315; 323/316
(58) Field of Search ..... 327/538, 543, 327/103; 323/312, 315, 316

(56) References Cited

U.S. PATENT DOCUMENTS 5,548,241 A * 8/1996 McClure ..... 327/538
5,646,518 A * 7/1997 Lakshmikumar et al. ... 323/316
5,812,028 A * 9/1998 Adachi et al. ..... 330/261
6,166,590 A * 12/2000 Friedman et al. ..... 327/543
6,191,645 B1 * 2/2001 Digele ..... 327/543
6,198,266 B1 * 3/2001 Mercer ..... 323/316

* cited by examiner

*Primary Examiner*—Terry D. Cunningham
(74) *Attorney, Agent, or Firm*—Oblon, Spivak, McClelland, Maier & Neustadt, P.C.

(57) ABSTRACT

In a source-type constant current driver circuit for driving an LED, a current of 1/β times a reference current is generated from a base current of a transistor Q2 for generating the reference current by means of the current mirror circuit composed of a transistor pair Q1*a*, Q1*b*. Further, the current generated by the current mirror circuit is amplified by a factor of n by means of a current mirror circuit composed of a transistor Q3 and one of transistors Q5*a* to Q5*h*. Then the amplified current is supplied to a base current of a transistor Q8. Thus, a base current of the transistor Q8 in a final stage is controlled.

12 Claims, 7 Drawing Sheets

CONSTANT CURRENT CIRCUIT USING CURRENT MIRROR CIRCUIT

CROSS-REFERENCE TO RELATED APPLICATIONS

This application is based upon and claims the benefit of priority from the prior Japanese Patent Applications No. 11-260269, filed Sep. 14, 1999; and No. 2000-098024, filed Mar.31, 2000, the entire contents of which are incorporated herein by reference.

BACKGROUND OF THE INVENTION

The present invention relates to a constant current circuit using a current mirror circuit. More specifically, the invention relates to a source-type constant current driver circuit and a sink-type constant current driver circuit which are used to drive an LED (Light Emitting Diode) etc.

Conventionally, as for the constant current circuit using the current mirror circuit, the source-type constant current driver circuit for driving the LED, for example, as shown in FIG. 1, is known. Here, description regarding circuits will be made assuming that the number of output bits is '8.' In FIG. 1, for example, a reference voltage source 101 for supplying a reference voltage is connected to one of input ports of an amplifier (Amp.) 102. An output port of the amplifier 102 is connected to a base of an NPN transistor (multiplying factor: ×10) Q101 for generating a reference current. An emitter of the transistor Q101 is connected to the other input port of the amplifier 102 and also connected to a terminal (REXT) 103. The terminal 103 is connected to one end of an external resistance R used for control of the output currents. Other end of the resistance R is connected to a terminal (GND) 104.

A collector of the transistor Q101 is connected to a base of a PNP transistor (×10) Q102. Moreover, the collector of the transistor Q101 is also connected to a collector of one transistor Q103*a* of a PNP transistor (×50, ×50) pair Q103*a,* Q103*b*. By the way, the transistor pair Q103*a,* Q103*b* is configured to have a current ratio of 1:1 and constitutes a current mirror circuit 105. Moreover, a collector of the transistor Q102 is grounded and an emitter thereof is connected to a common node of bases of the transistor pair Q103*a,* Q103*b*. Further, a collector of the transistor Q103*b* is connected to a collector of an NPN transistor (×10) Q104 and a base of an NPN transistor (×5) Q105, respectively.

On the other hand, a terminal 106 for supplying a power-supply voltage VDD (for example, 5V) is connected to each emitter of the transistor pair Q103*a,* Q103*b* and also connected to a collector of the transistor Q105.

An emitter of the transistor Q104 is connected to the terminal 104 and each emitter of NPN transistors (×10, . . . ) Q106*a* to Q106*h,* respectively. A base of the transistor Q104 is connected to an emitter of the transistor Q105. Moreover, a base of the transistor Q104 is connected to each base of the transistors Q106*a* to Q106*h* through switches 107*a* to 107*h,* respectively.

Here, the transistors Q106*a* to Q106*h* are provided according to the number of the output bits (in this case, 1 to 8 bits). In addition, each of the transistors Q106*a* to Q106*h* together with the transistor Q104 constitute the current mirror circuit whose current ratio is set to 1:1, respectively.

Each collector of the transistors Q106*a* to Q106*h* is connected to a base of a PNP transistor (×10) Q107, respectively. Moreover, each collector of the transistors Q106*a* to Q106*h* is connected to a collector of one transistor Q108*a* of a PNP transistor (×50, ×50) pair Q108*a,* Q108*b*. By the way, the transistor pair Q108*a,* Q108*b* constitutes a current mirror circuit 108 whose current ratio is set to 1:1. Here, for convenience' sake, here only the circuit for a first bit of the output is shown in the figure.

A collector of the transistor Q107 is grounded, and an emitter thereof is connected to a common node of bases of the transistor pair Q108*a,* Q108*b*. Further, the collector of the transistor Q108*b* is connected to a common node of bases of an NPN transistor (×10, ×150) pair Q109*a,* Q109*b* and also connected to a collector of one transistor Q109*a* of the transistor pair Q109*a,* Q109*b*. Moreover, the transistor pair Q109*a,* Q109*b* is configured to have a current ratio of 1:15 and constitutes a current mirror circuit 109.

Furthermore, each emitter of the transistor pair Q108*a,* Q108*b* and a collector of the transistor Q109*b* are connected to a terminal 110 for supplying a power-supply voltage VCC (for example, 17V), respectively. In addition, each emitter of the transistor pair Q109*a,* Q109*b* are both connected to a terminal (Out) 111.

According to the source-type constant current driver circuit of such a configuration as this can yield heavy-current outputs (in this case, 160 mA) each of which is formed by multiplying a reference current (for example 10 mA) by a factor of n according to an amplifying factor (current ratio) of the current mirror circuit 109. However, in the conventional source-type constant current driver circuit mentioned above, a useless circuit current (consumption current) i that reaches as high as 1/12 to 1/20 or so of the output current flows. Especially when the number of the output bits is large, the power consumption of the circuit increases because of the circuit current i according to the following formula: power consumption of the circuit=VCC voltage×output current/ratio of the circuit current i×the number of bits. Therefore, the circuit has a demerit that circuits having a large number of bits of the output are not suitable for a small size package.

For example, now, assume that a heavy-current of 160 mA is outputted and the circuit current i of 1/16 times the output current flows uselessly. Then, a power consumption of the circuit is obtained, according to the formula, as power consumption of the circuit =17V×160 mA/16×8=1.36 W. Further, a fact that the useless circuit current i is large means that desired output characteristic cannot be achieved unless the transistors are designed to be in large sizes. Therefore, the circuit of this type tends to bring about a larger chip size and an largely increased cost.

As described above, although the conventional base voltage control type of source-type constant current driver circuit makes possible a stable output of constant current, the useless circuit current at the time of outputting a heavy-current is large. Therefore, the circuit has problems that its power consumption tends to become large and it is liable to have a larger chip size and a largely increased cost.

BRIEF SUMMARY OF THE INVENTION

The object of the present invention is to provide a constant current circuit capable of decreasing its power consumption and also capable of being manufactured in a smaller size at the same time with a reduced cost.

A constant current circuit according to one aspect of the present invention, comprises a first transistor for generating a reference current in conformity to a reference voltage, a generator circuit for generating a current of 1/β times the reference current that is supplied for a base current of the first transistor, a transistor pair for amplifying by a factor of n the current that is generated by the generator circuit so as to be 1/β times the reference current, and a second transistor to which a current that is an n times amplified current by the transistor pair is supplied for a base current thereof.

According to the constant current circuit of the present invention, even when a heavy-current is required, the useless circuit current consumed by the circuit can be reduced to a small amount. As a result, a constant current circuit can be constructed as a low-consumption constant current circuit comprising small-size transistors.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described wit reference to the accompanying drawings.

(First Embodiment)

Figure 2:
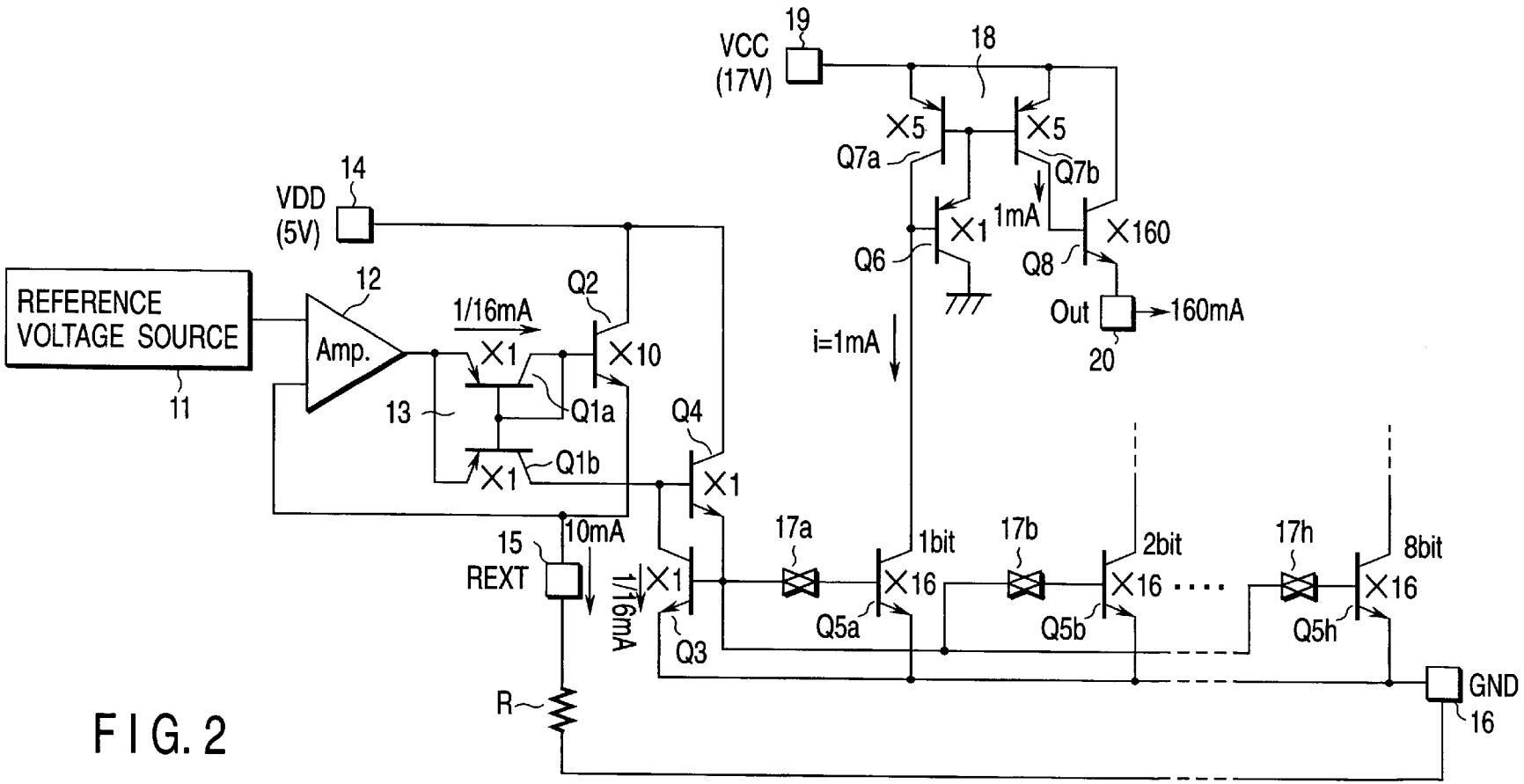
FIG. 2 is a circuit configuration diagram of a source-type constant current driver circuit according to a first embodiment of the present invention.

FIG. 2 shows a constant current circuit according to the first embodiment of the present invention taking as an example a case where the constant current circuit is applied to the source-type constant current driver circuit for driving the LED. Here, description is made for a case where the number of the output bits is set to '8.' In FIG. 2, for example, a reference voltage source 11 for supplying a reference voltage is connected to one of input ports of an amplifier (Amp.) 12. An output port of the amplifier 12 is connected to each emitter of a pair of PNP transistors (×1, ×1) Q1*a,* Q1*b* acting as a generator circuit.

The transistor pair Q1*a,* Q1*b* constitute a Wilson type of current mirror circuit 13 whose current ratio (mirror ratio) is set to 1:1. Each base of the transistor pair Q1*a,* Q1*b* are both connected to a common node. Further, the common node is connected to a collector of the transistor Q1*a*.

Moreover, the collector of the transistor Q1*a* is connected to a base of an NPN transistor (×10) Q2 acting as a first transistor. The transistor Q2 is for generating a reference current (in this case, 10 mA). A collector of the transistor Q1*b* is connected to a collector of an NPN transistor (×1) Q3, and also connected to a base of an NPN transistor (×1) Q4. A collector of the transistor Q4 is connected to a terminal 14 for supplying a power-supply voltage VDD (for example, 5V).

The terminal 14 is connected to a collector of the transistor Q2. Moreover, an emitter of the transistor Q2 is connected to other input port of the amplifier 12 and a terminal (REXT) 15, respectively. The terminal 15 is connected to one port of an external resistance R used for control of the output currents. Other port of the resistance R is connected to a terminal (GND) 16.

An emitter of the transistor Q3 is connected to the terminal 16 and each emitter of NPN transistors (×16, . . .) Q5*a* to Q5*h,* respectively. A base of the transistor Q3 is connected to an emitter of the transistor Q4. Moreover, a base of the transistor Q3 is connected to each base of the transistors Q5*a* to Q5*h* through switches 17*a* to 17*h,* respectively.

Here, the transistors Q5*a* to Q5*h* are provided according to the number of the output bits (in this case, 1 to 8 bits). Moreover, each of the transistors Q5*a* to Q5*h* together with the transistor Q3 constitute a current mirror circuit whose current ratio is set to 1:16, respectively.

Each collector of the transistors Q5*a* to Q5*h* is connected to a base of a PNP transistor (×1) Q6, respectively. Moreover, each collector of the transistors Q5*a* to Q5*h* is connected to a collector of one transistor Q7*a* of a PNP transistor (×5, ×5) pair Q7*a,* Q7*b,* respectively. By the way, the transistor pair Q7*a,* Q7*b* constitute a Wilson type of current mirror circuit 18 whose current ratio is set to 1:1. By the way, for convenience' sake, here only a circuit for a first bit of the output is shown in the figure.

A collector of the transistor Q6 is grounded, and an emitter thereof is connected to a common node of each base of the transistor pair Q7*a*, Q7*b*. Each emitter of the transistor pair Q7*a*, Q7*b* are both connected to a terminal 19 for supplying a power-supply voltage VCC (for example, 17V).

Moreover, a collector of the transistor Q7*b* is connected to a base of an NPN transistor (×160) Q8 acting as a second transistor in a final stage of the output. A collector of the transistor Q8 is connected to the terminal 19, and an emitter thereof is connected to a terminal (Out) 20.

In the source-type constant current driver circuit of the base current control type of such a configuration as this, a current of 1/β (in this case, β=160)×the reference current (equal to 1/16 mA) is generated by means of the current mirror circuit 13 from a base current of the transistor Q2 for generating the reference current. Further, the current is amplified by a factor of n (in this case, 16 times) by means of each current mirror circuit composed of the transistor Q3 and one of the transistors Q5*a* to Q5*h*. After this, the amplified current is supplied for a base current (1 mA) of each transistor Q8 in the final stage of the output. As a result, a heavy-current output (160 mA) that is n times the reference current is obtained for each one bit.

The consumption current (useless circuit current) i in the constant current circuit at the time of outputting the heavy-current of 160 mA is 1/1 times the output current. Therefore, the power consumption of the circuit due to the useless circuit current i is expressed in the following formula: Power consumption of the circuit=VCC voltage×output current/β× the number of bits=17V×160 mA/160×8=0.136 W.

Figure 1:
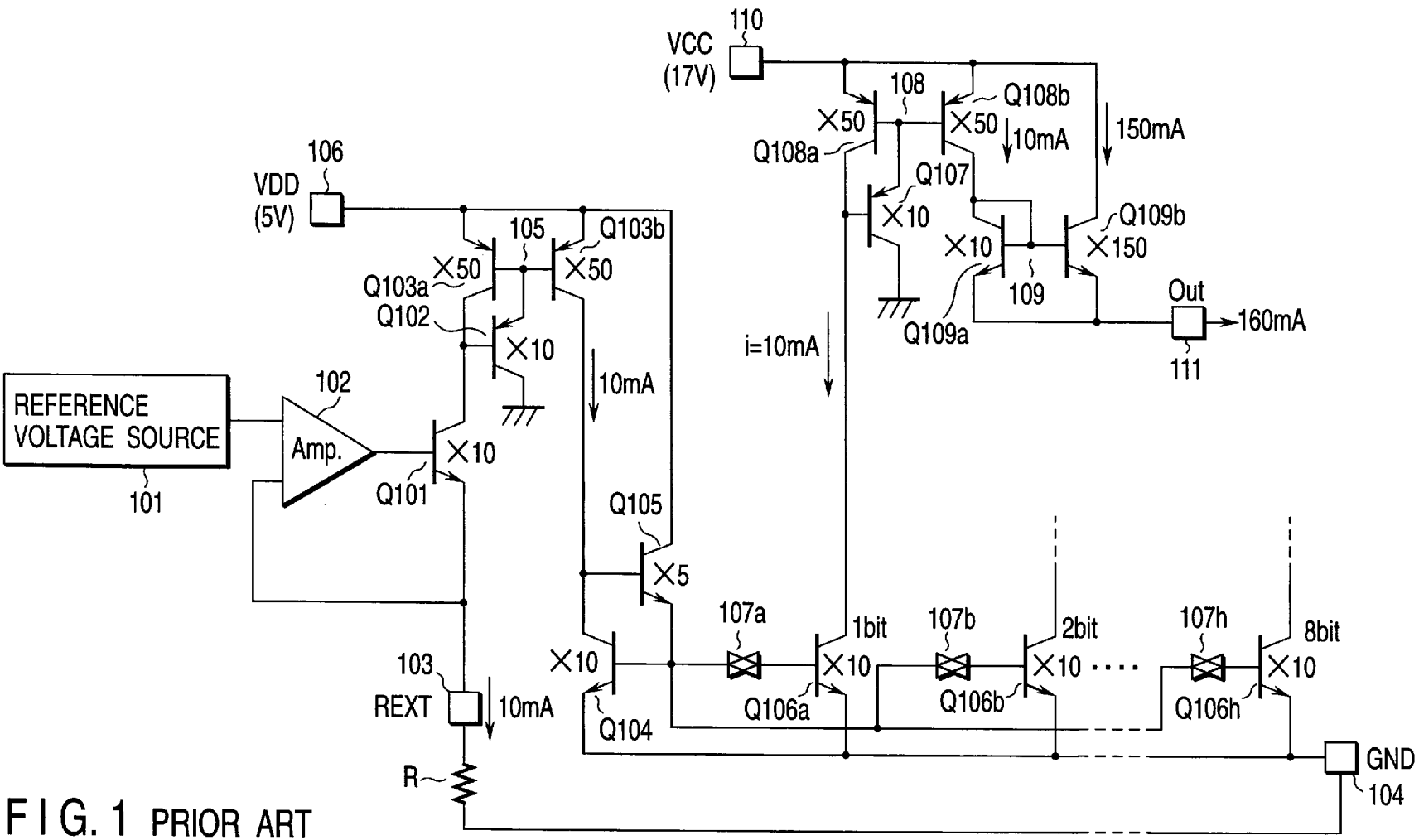
FIG. 1 PRIOR ART
FIG. 1 is a circuit configuration diagram of a source-type constant current driver circuit shown for the purpose of explaining the prior art and a problem thereof.

Hence the power consumption can be smaller than that of the conventional circuit (see FIG. 1). By the way, the β is a current amplifying factor of the transistor Q2. This value varies depending upon a manufacturing process of the transistor Q2 etc.

Thus, even when a heavy-current is required as an output, adoption of the constant current circuit makes possible to reduce the useless circuit current consumed by the circuit. Therefore, the present invention can realize a constant current circuit having a low consumption current and a small β dependency. That is, the circuit current can be decreased to be a small quantity. As a result, increase of the power consumption can be suppressed, and this feature makes the circuit suitable for small-size packaging. Moreover, since the circuit current is small, the circuit can be composed of small-size transistors. Therefore, the present invention is useful for miniaturizing a chip size and reducing a cost.

By the way, in the first embodiment described above, the source-type constant current driver circuit is described as an example. It should be noted that the present invention is not limited to this but can be applied to, for example, the sink-type constant current driver circuit.

(Second Embodiment)

Figure 3:
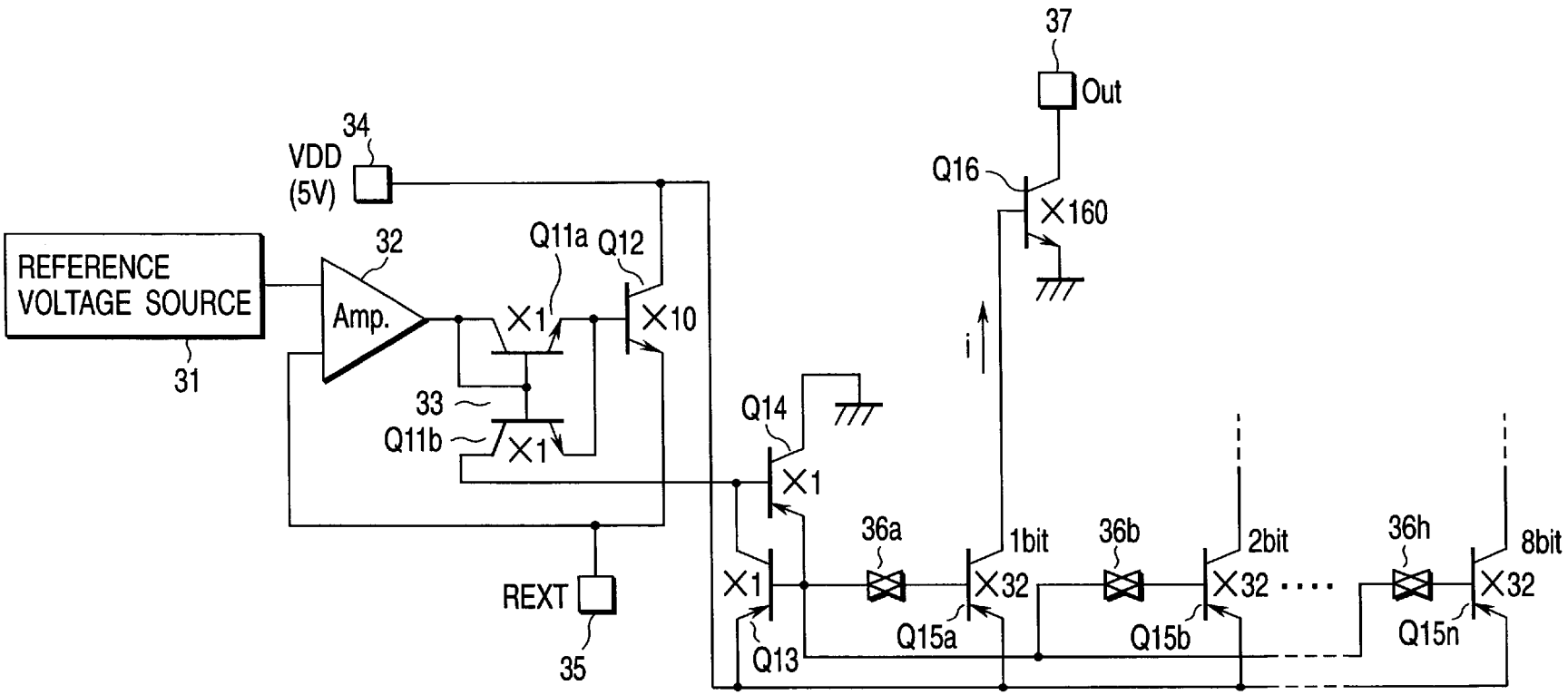
FIG. 3 is a circuit configuration diagram of a sink-type-constant current driver circuit according to a second embodiment of the present invention.

FIG. 3 shows the constant current circuit according to the second embodiment of the present invention taking as an example a case where the constant current circuit is applied to a sink-type constant current driver circuit for driving the LED. Here, description is made for a case where the number of the output bits is set to '8.' In FIG. 3, for example, a reference voltage source 31 for supplying a reference voltage is connected to one of input ports of an amplifier (Amp.) 32. An output port of the amplifier 32 is connected to a collector of one NPN transistor Qll*a* of a pair of NPN transistors (×1, ×1) Q11*a*, Q11*b* acting as a generator circuit. Further, the output port of the amplifier 32 is also connected to a common node of each base of the transistor pair Q11*a*, Q11*b*.

The transistor pair Q11*a*, Q11*b* constitute a Wilson type of current mirror circuit 33 whose current ratio (mirror ratio) is set to 1:1. Each emitter of the transistor pair Q11*a*, Q11*b* are both connected to a base of an NPN transistor (×10) Q12 acting as a first transistor. The transistor Q12 is for generating a reference current (in this case, 10 mA).

A collector of the transistor Q11*b* is connected to a collector of a PNP transistor (×1) Q13 and a base of a PNP transistor (×1) Q14, respectively. A collector of the transistor Q14 is grounded.

A collector of the transistor Q12 is connected to a terminal 34 for supplying a power-supply voltage VDD (for example, 5V). Moreover, an emitter of the transistor Q12 is connected to other input port of the amplifier 32 and also connected to a terminal (REXT) 35 to which an external resistance used for control of the output current (not shown in the figure) is connected.

An emitter of the transistor Q13 is connected to the terminal 34 and each emitter of PNP transistors (×32, . . .) Q15*a* to Q15*h*, respectively. A base of the transistor Q13 is connected to an emitter of the transistor Q14. Further, a base of the transistor Q13 is connected to each base of the transistors Q15*a* to Q15*h* through switches 36*a* to 36*h*, respectively.

Here, the transistors Q15*a* to Q15*h* are provided according to the number of the output bits (in this case, 1 to 8 bits). Moreover, each of the transistors Q15*a* to Q15*h* together with the transistor Q13 constitute a current mirror circuit whose current ratio is set to 1:32, respectively.

Each collector of the transistors Q15*a* to Q15*h* is connected to a base of an NPN transistor (×160) Q16 acting as a second transistor in a final stage of the output, respectively. An emitter of the transistor Q16 is grounded, and a collector thereof is connected to a terminal (Out) 37. By the way, for convenience' sake, here only a circuit for a first bit of the output is shown in the figure.

In the sink-type constant current driver circuit of the base current control type of such a configuration as this, a current 1/2×β (in this case, β=160) times the reference current (equal to 1/32 mA) is generated by means of the current mirror circuit 33 from a base current of the transistor Q12 for generating the reference current. Further, the current is amplified by a factor of n (in this case, 32 times) by means of each current mirror circuit composed of the transistor Q13 and one of the transistors Q15*a* to Q15*h*. After this, the amplified current is supplied for a base current (1 mA) of each transistor Q16 in the final stage of the output. As a result, a heavy-current output (160 mA) that is n times the reference current is obtained for each one bit.

The consumption current (useless circuit current) i in the constant current circuit at the time of outputting the heavy-current of 160 mA is 1/β times the output current. Therefore, the power consumption of the circuit due to the useless circuit current i can be also reduced to smaller than that of the conventional circuit (see FIG. 1). By the way, the β denotes a current amplifying factor of the transistor Q12. This value may vary depending upon a manufacturing process of the transistor pair Q11*a*, Q11*b* etc.

Figure 4A:
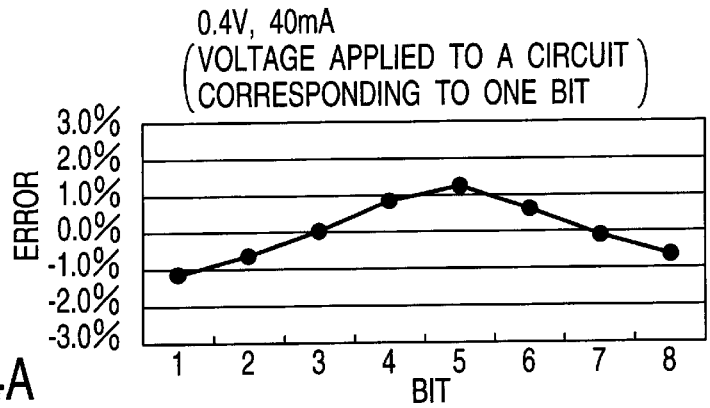
FIG. 4A is a view showing a result of simulation of the conventional source-type constant current driver circuit, being taken for example (in the case where the number of terminals for GND is assumed to '1' and a voltage is applied to each circuit corresponding to one bit sequentially, one circuit by one circuit) in order to explain reduction effect of errors of the output currents in each bit in the sink-type constant current driver circuit.
Figure 4B:
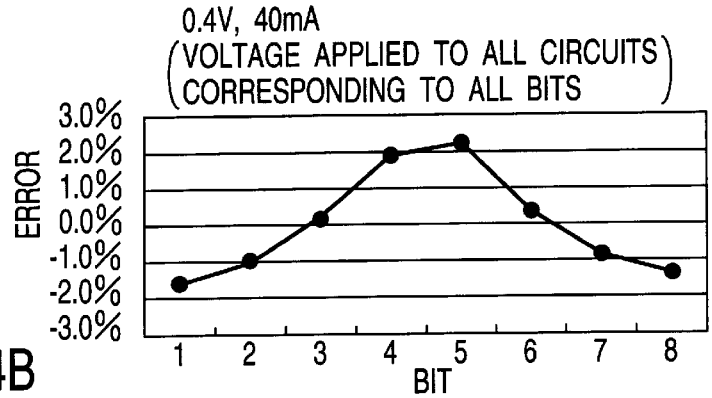
FIG. 4B is a view showing a result of simulation to examine errors of the output currents in each bit in the case where the number of terminals for GND is assumed to be '1' and the voltage is applied to all circuits corresponding to all bits.
Figure 5A:
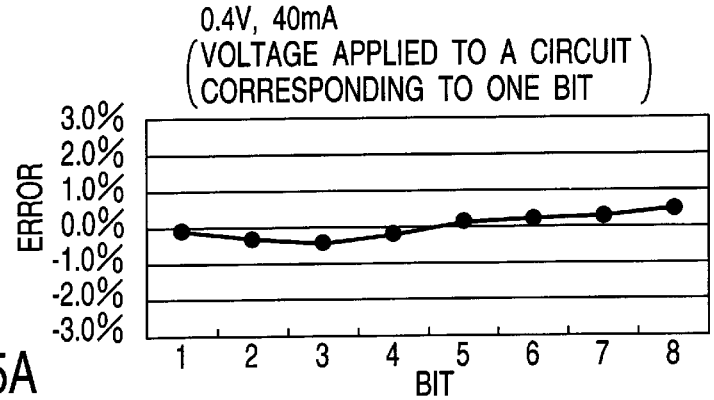
FIG. 5A is a view showing a result of simulation of the conventional source-type constant current driver circuit, being taken for example (in the case where the number of terminals for GND is assumed to '3' and a voltage is applied to each circuit corresponding to one bit sequentially, one circuit by one circuit) in order to explain the reduction effect of errors of the output currents in each bit in the sink-type constant current driver circuit.
Figure 5B:
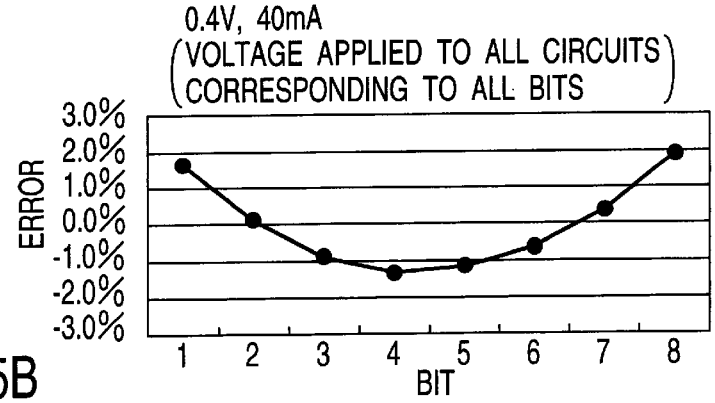
FIG. 5B is a view showing a result of simulation to examine errors of the output currents in each bit in the case where the number of terminals for GND is assumed to be '3' and the voltage is applied to all circuits corresponding to all bits.

Next, in the sink-type constant current driver circuit of a configuration shown in FIG. 3, the effect of the reduction of errors in the output currents in each bit will be described. Here, FIGS. 4A, 4B and FIGS. 5A, 5B are views showing results of simulation carried out for the errors of the output currents in each bit taking the conventional source-type constant current driver circuit (see FIG. 1) for example. Describing specifically, FIG. 4A is a result of simulation carried out for the errors of the output currents in each bit in the case where the number of terminals for GDN is assumed to '1' and a voltage (Vce) is applied to each circuit corresponding to one bit sequentially, one circuit by one circuit. FIG. 4B is a result of simulation carried out to examine the errors of the output currents in each bit in the case where the number of terminals for GND is assumed to '1' and the voltage is applied to all circuits corresponding to all bits. FIG. 5A is a result of simulation to examine the errors of the output currents in each bit in the case where the number of terminals for GND is assumed to be plurality (for example, '3') and a voltage (Vce) is applied to each circuit corresponding to one bit sequentially, one circuit by one circuit. FIG. 5B is a result of simulation to examine the errors of the output currents in each bit in the case where the number of terminals for GND is assumed to be plurality (for example, '3') and the voltage is applied to all circuits corresponding to all bits.

As is clear from FIGS. 4A, 4B and FIGS. 5A, 5B, the errors of the output currents in each bit can be reduced by increasing the number of terminals for GND. That is, in the case of the conventional source-type constant current driver circuit, the output current is controlled by fixing a base voltage of the transistor Q104. In the circuit of such a configuration as this, for example, an Al (Aluminum) line serving as grounding wiring for connecting each emitter of the transistors Q106*a* to Q106*h* and the GND terminal (numeral 104 in FIG. 1) has an Al impedance. Because of this, a voltage difference occurs among the emitter voltages of transistors Q106*a* to Q106*h,* which causes a variation in the base-to-emitter voltages (Vbe) of the respective transistors (although the Al impedance is only a few tens of milliohms or so, but if a current of 100 mA flows there, a voltage difference of a few mV occurs. This problem becomes larger when the number of the output bits increases.) Therefore, when the simulation is carried out, the variation in the base-to-emitter voltages due to the Al impedance results in the interbit errors of the output currents in each bit (FIG. 4A).

Such errors of the output currents can be reduced by increasing the number of terminals for GND to effect disposal of an apparent GND impedance (making it invisible)(FIG. 5A). However, increasing the number of terminals for GND invites enlargement of the chip size. Moreover, this also increases the number of pins of an envelope. Therefore, this technology doesn't fit for small-size packaging. Furthermore, as shown in FIG. 4B and FIG. 5B, the errors of the output currents in each bit depend largely upon a location where a terminal for GND is installed (for example, a relative location of the terminal with respect to a transistor in a final stage of the output).

Figure 6A:
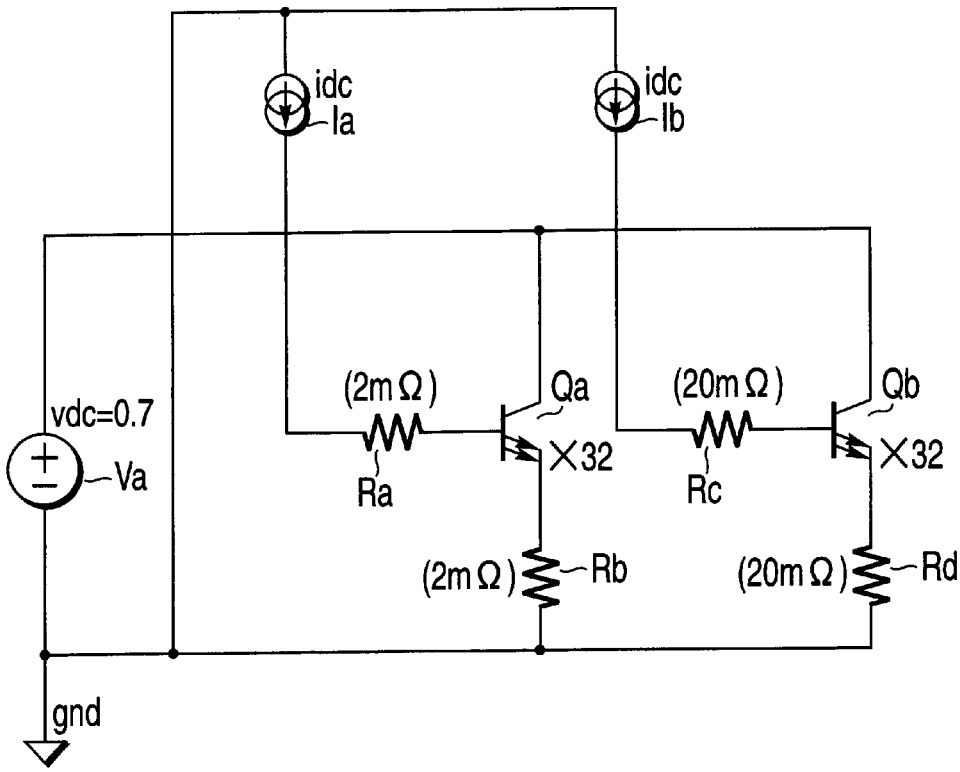
FIG. 6A is a circuit configuration diagram of the base current control type of control circuit in order to explain the reduction effect of errors of the output currents in each bit in the sink-type constant current driver circuit.
Figure 6B:
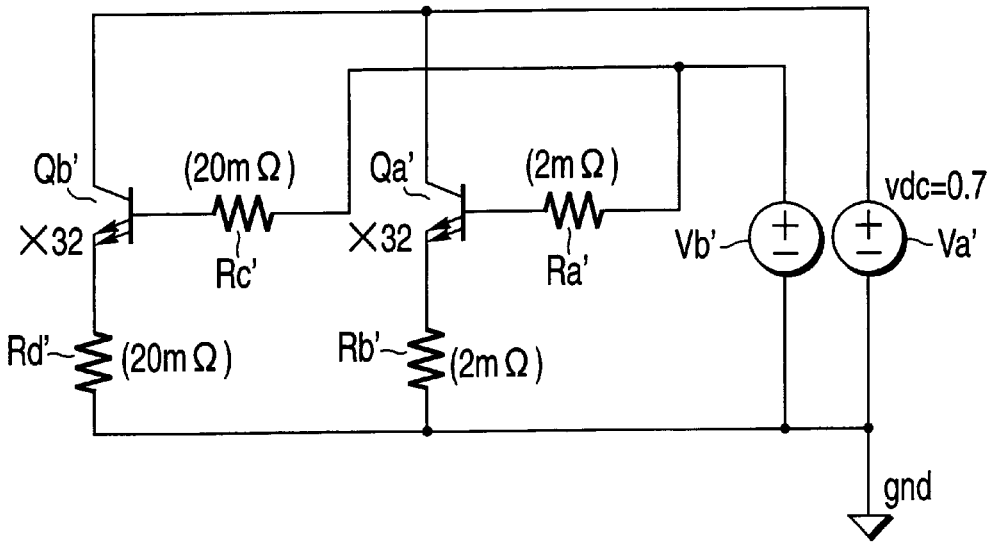
FIG. 6B is a circuit configuration diagram of the base voltage control type of control circuit.
Figure 8:
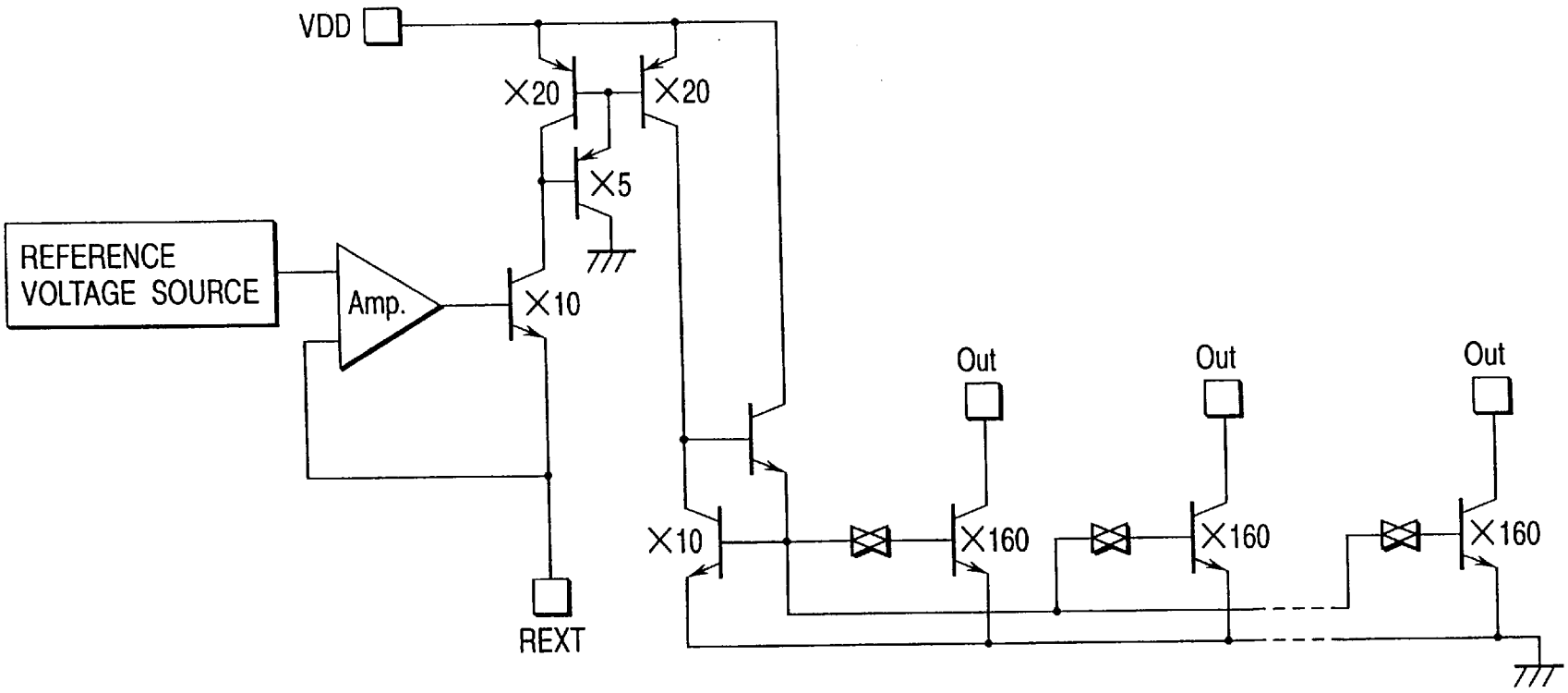
FIG. 8 is a circuit configuration diagram of a sink-type constant current driver circuit shown for the prior art.

FIGS. 6A and 6B are views showing a configuration of a control circuit of a type of controlling a base current of a transistor in comparison with a control circuit of a type of controlling a base voltage. By the way, in this case, FIG. 6A is a view showing a configuration of a control circuit of a type of controlling a base current of a transistor, which corresponds to a final stage (for two bits) of the output of the sink-type constant current driver circuit shown in FIG. 3. Moreover, FIG. 6B is a view showing a configuration of a control circuit of a type of controlling a base voltage, which corresponds to a final stage of the output (for two bits) of the conventional sink-type constant current driver circuit shown in FIG. 8.

That is, as shown in FIG. 6A, in the case of the base current control type of control circuit, transistors Q*a,* Q*b* correspond to the transistor Q16 of the sink-type constant current driver circuit shown in FIG. 3. A base of the transistor (×32) Q*a* whose Vbe impedance is small is connected to a constant current source Ia for supplying a base current though a resistance Ra (for example, 2 mΩ) acting as the Al impedance. A collector of the transistor Qa is connected to a constant voltage source Va, and an emitter thereof is grounded through a resistance Rb (for example, 2 mΩ) acting as the Al impedance. Moreover, a base of a transistor (×32) Qb whose Vbe impedance is large is connected to a constant current source Ib for supplying a base current through a resistance Rc (for example, 20 mΩ) acting as the Al impedance. A collector of the transistor Qb is connected to a constant voltage source Va, and an emitter thereof is grounded through a resistance Rd (for example, 20 mΩ) acting as the Al impedance.

On the other hand, as shown in FIG. 6B, in the case of the base voltage control type of control circuit, a base of a transistor (×32) Qa' whose Vbe impedance is small is connected to a constant voltage source Vb' for supplying a base voltage through a resistance Ra' (for example, 2 mΩ) acting as the Al impedance. A collector of the transistor Qa' is connected to a constant voltage source Va', and an emitter thereof is grounded through a resistance Rb' (for example, 2 mΩ) acting as the Al impedance. Further, a base of a transistor (×32) Qb' whose Vbe impedance is large is connected to a constant voltage source Vb' for supplying a base voltage through a resistance Rc' (for example, 20 mΩ) acting as the Al impedance. A collector of the transistor Qb' is connected to a constant voltage source Va', and an emitter thereof is grounded through a resistance Rd' (for example, 20 mΩ) acting as the Al impedance.

Table 1 shows a result of simulation carried out for the output currents of the transistors Qa, Qb, Qa', Qb' in the case where the base current control type of control circuit shown in FIG. 6A is used and in the case where the base voltage control type of control circuit shown in FIG. 6B is used.

TABLE 1

| | Base voltage control | | Base current control |
|---|---|---|---|
| VR voltage | 794.5 mV | Base current | 385 μA |
| Qb' | 39.30 mA | Qb | 40.01 mA |
| Qa' | 40.00 mA | Qa | 40.01 mA |
| Error | 1.78% | Error | 0.00% |

As shown in table 1, in the case of the base current control type of control circuit, the base-to-emitter voltages of the transistors Qa, Qb are determined by the base current. Therefore, voltage difference between emitter voltages (due to Al impedance) has an influence only on a collector-to-emitter voltage (Vce). Therefore, there is no error in the output current. To verify this fact, simulation was carried out with a base current varied in magnitude by 1%, and output of 40.01 mA for the transistor Qb (base current=385.00 μA) and output of 40.39 mA for the transistor Qb (base current= 388.85 μA) are obtained, giving the error of 0.95%.

Moreover, in the case of the base current control type of control circuit, the output current doesn't depend upon a layout of the control circuit. To check this, the simulation was carried out after calculating the resistance component of the Al line (Al impedance) from the layout of the control circuit. The error of the output current obtained as the characteristics of the output current is, in the worst case, −0.05% or so even when the resistance component of the Al line is considered (note that Iref current=6 mA).

From the above fact, it can be thought that in the case of the sink-type constant current driver circuit of a configuration shown in FIG. 3, the base-to-emitter voltage (Vbe) of the transistor depends upon the base current. Therefore, according to the circuit of this configuration, the variation in the Vbe due to the Al impedance can be prevented. As a result, it is possible to reduce the errors of the output currents in each bit without increasing the number of terminals for GND. It should be noted that, when the errors of the output currents in each bit are intended to be reduced, the Al impedance has an influence only on Vce. Therefore, unlike the conventional sink-type constant current driver circuit, there doesn't exist such a problem that with increasing number of terminals for GND, the chip size becomes larger.

(Third Embodiment)

Figure 7:
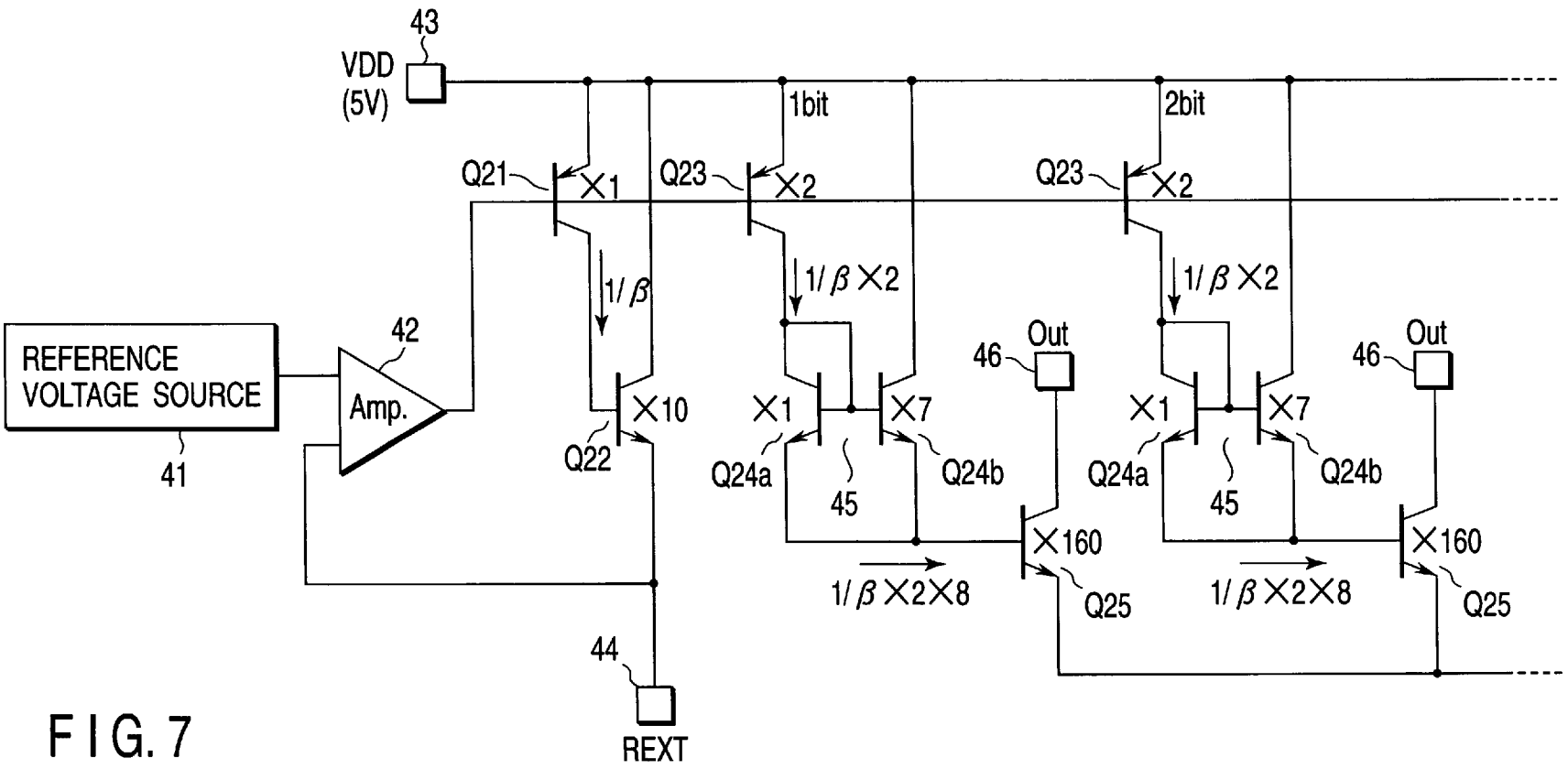
FIG. 7 is a circuit configuration diagram of the sink-type constant current driver circuit according to a third embodiment of the present invention.

FIG. 7 shows other example of the sink-type constant current driver circuit for driving the LED as a constant current circuit according to a third embodiment of this invention. In FIG. 7, for example, a reference voltage source 41 for supplying a reference voltage is connected to one of input ports of an amplifier (Amp.) 42. An output port of the amplifier 42 is connected to a base of a PNP transistor (×1) Q21 as acting as a generator circuit. A collector of the transistor Q21 is connected to a base of an NPN transistor (×10) Q22 acting as a first transistor. The transistor Q22 is for generating a reference current (in this case, 10 mA). Moreover, an emitter of the transistor Q21 is connected to a terminal 43 for supplying a power-supply voltage VDD (for example, 5V).

An emitter of the transistor Q22 is connected to other input port of the amplifier 42 and also connected to a terminal (REXT) 44 to which an external resistance used for control of the output current (not shown in the figure) is connected. Moreover, a collector of the transistor Q22 is connected to the terminal 43.

On the other hand, an output port of the amplifier 42 is connected to each base of a plurality of PNP transistors (×2) Q23 that are further provided according to the number of the output bits. Each of the transistors Q23 together with the transistor Q21 constitute a current mirror circuit whose current ratio is set to 1:2.

Each emitter of the transistors Q23 is connected to the terminal 43, respectively. Moreover, each collector of the transistors Q23 is connected to a common node of bases of an NPN transistor (×1, ×7) pair Q24*a,* Q24*b* and also connected to each collector of the transistor Q24*a,* respectively. Each of the transistor pairs Q24*a,* Q24*b* constitute a Wilson-type current mirror circuit 45 whose current ratio (mirror ratio) is set to 1:7, respectively.

Each emitter of the transistors Q24*a* is connected to each emitter of the transistors Q24*b* and each base of NPN transistors (×160) Q25 acting as a second transistor in a final stage of the output, respectively. Moreover, each collector of the transistors Q24*b* is connected to the terminal 43, respectively. Further, each emitter of the transistors Q25 is connected to a common node, and each collector thereof is connected to each terminal (Out) 46.

In the base current control type of sink-type constant current driver circuit of such a configuration as this, a current of 1/β (in this case, β=160) times the reference current (equal to 1/16 mA) is generated by a transistor Q21 from a base current of the transistor Q22 for generating the reference current. Further, the current is amplified by a factor of 2 by each current mirror circuit composed of the transistor Q21 and the transistor Q23. Furthermore, the amplified current is amplified by a factor of 8 by each current mirror circuit 45 composed of the transistor pair Q24*a,* Q24*b*. After this, the amplified current is supplied for a base current (1 mA) of each transistor Q25 in a final stage of the output. As a result, a heavy-current output (160 mA) that is n times the reference current can be obtained for each bit.

The consumption current (useless circuit current) i in the constant current circuit at the time of outputting the heavy-current of 160 mA is 1/β times the output current. Therefore, the power consumption of the circuit due to the useless circuit current i can be decreased to be lower than that of the conventional circuit (see FIG. 8), similarly to the case of the sink-type constant current driver circuit whose configuration is in accordance with the second embodiment. By the way, the β denotes a current amplifying factor of the transistor Q22. This value varies depending upon a manufacturing process of the transistor Q22 etc.

As described in detail in the foregoing, according to this invention, the constant current circuit whose power consumption can be reduced and that is capable of being realized in a smaller size at the same time with a reduced cost can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A constant current circuit comprising:

a first transistor for generating a reference current in conformity to a reference voltage;

a generator circuit connected to the reference voltage for generating a current of 1/β times said reference current that is supplied for a base current of said first transistor;

a transistor pair circuit for amplifying by a factor of n the current that is generated by said generator circuit so as to be 1/β times this reference current;

a second transistor to which the current that is the n times amplified current by said transistor pair circuit is supplied for a base current thereof; and wherein β and n are integers greater than zero.

2. A constant current circuit according to claim 1, wherein said generator circuit comprises:

an amplifier such that said reference voltage is supplied to one of input ports thereof and at the same time said reference current is supplied to other input port;

a current mirror circuit to which an output of said amplifier is supplied; and (c) an external resistance used for control of the output current to which said reference current is supplied.

3. A constant current circuit according to claim 2, wherein said current mirror circuit is the Wilson-type current mirror circuit composed of two PNP transistors.

4. A constant current circuit according to claim 3, wherein said two PNP transistors are set to have a current ratio of 1:1.

5. A constant current circuit according to claim 2, wherein said current mirror circuit is the Wilson-type current mirror circuit composed of two NPN transistors.

6. A constant current circuit according to claim 5, wherein said two NPN transistors are set to have a current ratio of 1:1.

7. A constant current circuit according to claim 1, wherein said transistor pair circuit and said second transistor are provided according to the number of output bits, respectively.

8. A constant current circuit according to claim 7, wherein said transistor pair circuit constitutes a current mirror circuit whose current ratio is set to 1:n.

9. A constant current circuit according to claim 7, wherein said second transistor is an NPN transistor in a final stage that outputs a current of n times said reference current.

10. A constant current circuit according to claim 1, wherein said generator circuit comprises:

an amplifier such that said reference voltage is supplied to one of input ports thereof and said reference current is supplied to other input port;

a first PNP transistor to which an output of said amplifier is supplied; and an external resistance used for control of the output current to which said reference current is supplied.

11. A constant current circuit according to claim 10, wherein the constant current circuit further comprises a second PNP transistor that is connected to said first PNP transistor so as to constitute a current mirror circuit.

12. A constant current circuit according to claim 11, wherein said first and second PNP transistors are set to have a current ratio of 1:2.

* * * * *

UNITED STATES PATENT AND TRADEMARK OFFICE

CERTIFICATE OF CORRECTION

PATENT NO. : 6,337,596 B1
DATED : January 8, 2002
INVENTOR(S) : Shimozono

It is certified that error appears in the above-identified patent and that said Letters Patent is hereby corrected as shown below:

Title page,
Item [30], the Foreign Application Priority Data should read as follows:

-- [30] Foreign Application Priority Data

Sep. 14, 1999 (JP) …….. 11-260269
Mar. 31, 2000 (JP) …….. 2000-098024 --

Signed and Sealed this

Twentieth Day of August, 2002

*Attest:*

*Attesting Officer*

JAMES E. ROGAN
*Director of the United States Patent and Trademark Office*